United States Patent [19]

Gorsek

[11] Patent Number: 4,779,305

[45] Date of Patent: Oct. 25, 1988

[54] POSITIVE-POSITIONING KNOB ASSEMBLY

[75] Inventor: Edmund J. Gorsek, Springfield, Ill.

[73] Assignee: Dickey-john Corporation, Auburn, Ill.

[21] Appl. No.: 941,378

[22] Filed: Dec. 15, 1986

[51] Int. Cl.[4] ..... B25G 3/00

[52] U.S. Cl. ..... 16/121; 16/DIG. 30; 74/553

[58] Field of Search ..... 16/121, DIG. 30; 74/10.1, 10.2, 10 R, 10.15, 553; D13/21; 338/199, 197, 167, 184

[56] References Cited

U.S. PATENT DOCUMENTS

| | | | |
|---|---|---|---|
| 2,704,466 | 3/1955 | Way | 74/533 |
| 3,505,884 | 4/1970 | Ford et al. | 74/10.2 |
| 4,084,675 | 4/1978 | Smith et al. | 74/10.2 |

*Primary Examiner*—Fred A. Silverberg

*Attorney, Agent, or Firm*—Trexler, Bushnell, Giangiorgi & Blackstone, Ltd.

[57] ABSTRACT

A positive-positioning knob assembly comprises a knob body having a substantially hollow interior portion and a pinion member fixed against rotation relative to a panel, through which panel extends a shaft to be rotated by the knob assembly. Cooperating selectively interengageable and disengageable locking members are located on the pinion member and the hollow body interior respectively for alternatively permitting the body to rotate freely of the pinion member when the locking members are in a disengaged condition, and for locking the body non-rotatably relative to the pinion when the locking members are in an engaged condition. A resilient biasing member normally holds the locking members in the engaged condition to prevent rotation of the know body; however, the resilient biasing member is resiliently deformable for permitting the locking members to move to the disengaged condition to permit rotation of the knob body.

13 Claims, 2 Drawing Sheets

POSITIVE-POSITIONING KNOB ASSEMBLY

BACKGROUND OF THE INVENTION

This invention is directed generally to control members such as knobs, and more particularly to a positive-positioning knob assembly which may be used on any device having a rotatable shaft which requires positive incremental positioning or "detenting".

Many rotating control devices such as potentiometers, rotary switches, or the like require positive detenting or incremental positioning to achieve and maintain separately definable positions thereof. For example, such positions might correspond with preselected incremental values of resistance of a potentiometer, and be defined by a knob or dial member having a pointer or other indicia alignable with incrementally located indicia on a facing panel or the like. In order to achieve such incremental positioning or detenting action, various mechanical releasable interlocking or detenting arrangements may be utilized. Many such arrangements utilize simple cam arrangements wherein a cam member rides over a series of facing cam members positioned incrementally to approximate the desired incremental positioning of the knob or other control member. Such arrangements may require only an increased rotational force or torque applied to the knob or control member to achieve the incremental movement. However, many applications require either a more accurately defined, or more finely resolved incremental positioning capability than possible with a simple cam arrangement. Other installations may additionally require that the knob or other control member be more positively locked against movement upon reaching or achieving a desired position or setting, such that some additional locking or unlocking manipulation, other than mere increased rotational force or torque is required to release and reposition the knob or other member.

The present invention proposes a relatively simple and inexpensive positive positioning and incrementally positionable, releaseably locking knob assembly which achieves the foregoing objects. That is, the knob assembly of the invention permits incremental rotation of a control shaft, or other member over a broad range of coarse to fine resolutions of equal incremental angular positions out of a 360 degree or any other desired total angular range of rotation. Moreover, the knob assembly of the invention provides a positive locking feature which requires positive manipulation of the knob in a direction other than the rotational direction for release thereof to achieve repositioning of the same. This locking feature automatically takes effect when the knob is released following revolution thereof to lock the same substantially in the last rotational or angular position achieved during revolution.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in connection with the accompanying drawings in the several figures of which like reference numerals identify like elements, and in which:

DETAILED DESCRIPTION OF THE ILLUSTRATED EMBODIMENT

Figure 1:
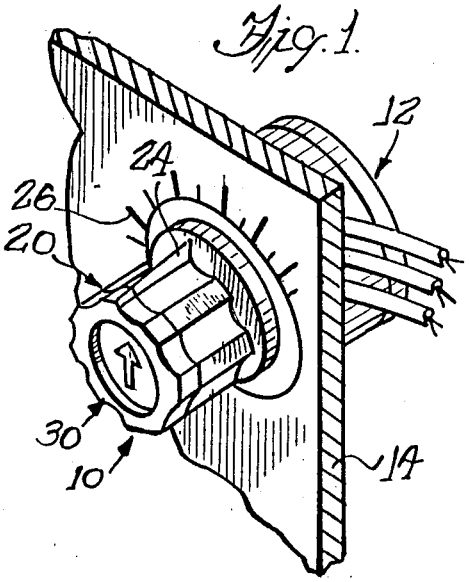
FIG. 1 is a perspective view illustrating a potentiometer or similar device mounted to a broken-away portion of a panel and provided with a positive-positioning control knob assembly in accordance with the invention.

Referring now to the drawings and initially to FIG. 1, a positive-positioning knob assembly in accordance with the invention is designated generally by the reference numeral 10. In FIG. 1, the knob 10 is illustrated in connection with a potentiometer or variable resistor type of control device designated generally by the reference numeral 12. However, it will be understood that the knob 10 is useful over a broad range of other applications as well. In the illustrated embodiment, this potentiometer 12 is mounted to one side of a wall or panel 14 and has a projecting rotatable control shaft 16 (see FIGS. 3–6), which extends through an aperture 18 provided therefor in the wall or panel 14 and for some distance to the other side thereof.

As will be more fully described hereinbelow, a portion of the knob assembly 10 is mounted non-rotatably relative to this control shaft 16 for rotating the same to achieve the desired control of the setting or position of the shaft and hence of the setting and resultant resistance value of the potentiometer 12.

Referring now also to the remaining figures of drawings, the knob assembly 10 will be seen to include a knob body member or portion 20, which in the illustrated embodiment is a substantially cylindrical member, grooved or knurled on its exterior surface to facilitate gripping thereof. In the illustrated embodiment, the body 20 terminates at a lower end thereof in an outwardly flared skirt 22.

Figure 9:
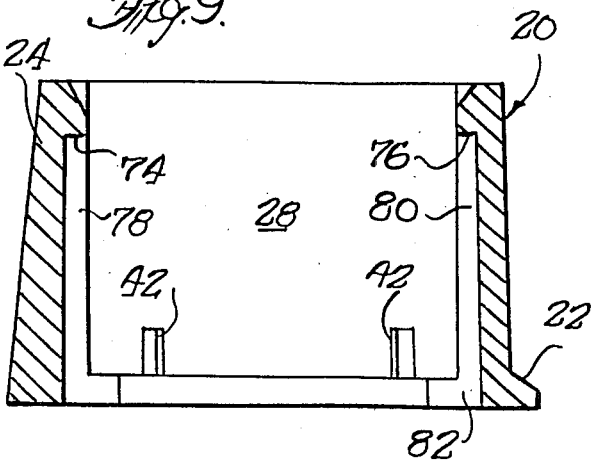
FIG. 9 is a sectional view similar to FIG. 3 of a body portion of the knob of the invention.

The body is provided with a preferably radially projecting indicia or pointer portion 24 for cooperating, for example, with indicia 26 on an adjacent surface of panel 14 to indicate the relative positioning of the shaft and hence setting or value of the potentiometer 12. In the illustrated embodiment, the body 20 is an open-ended member having a substantially cylindrical hollow interior defined by interior wall 28, as best viewed in FIG. 9.

Figure 2:
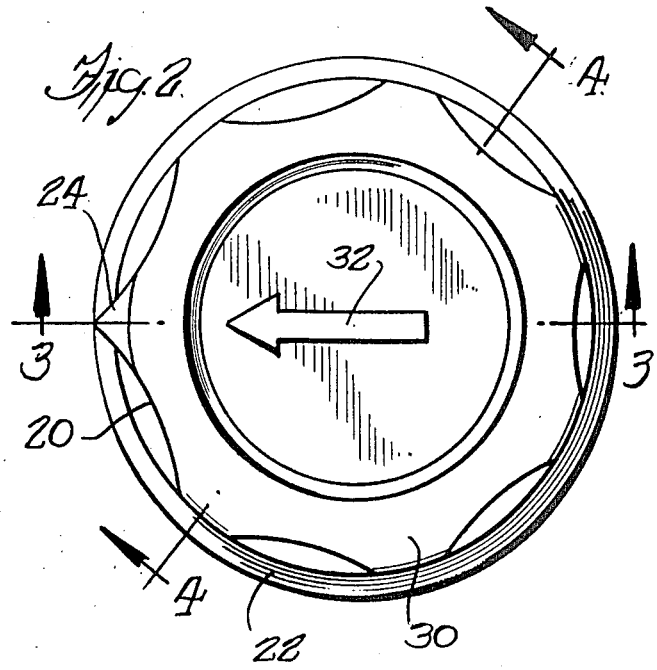
FIG. 2 is an enlarged top plan view of a knob assembly according t the invention.

An additional cap means or member 30 interfits with the uppermost or outermost end of open-ended body 20 relative to panel 14. This cap 30 may have a corresponding indicia or arrow 32 formed thereon as shown for example in FIG. 2. In accordance with the invention, this cap 30 is mounted non-rotatably relative to the body 20 and also to the shaft 16, as will be described in further detail hereinbelow. Hence the cap 30 not only provides a top closure for the knob body 20 but also provides means for rotating the shaft 16 in response to rotation of the body 20, as for example by gripping and manually turning the same.

In order to achieve the desired positive-positioning or locking feature of the knob 10, a pinion means or member 34 is non-rotatably mounted relative to the panel 14. In the illustrated embodiment, this pinion is held non-rotatable by a projecting locating pin or post 36 on the body of the pinion member 34, which post is engaged within a complementary aperture formed therefor in the panel 14. However, other means for so positioning the pinion may be provided without departing from the invention.

Cooperatively, the pinion 34 on the one hand, and the interior wall 28 of the body on the other hand, are provided with selectively interengageable and disengageable locking means. These locking means cooperate for alternatively permitting the body and shaft to rotate freely of the pinion when these locking means are in a disengaged condition, and for locking the body and shaft non-rotatably relative to the pinion when these locking means are in an engaged condition. In the illustrated embodiment, the locking means take the form of a plurality of circumferentially substantially equally spaced, radially projecting pinion teeth 40, about a periphery of the pinion 34, and one or more complementary, radially inwardly projecting teeth 42 formed on the inner wall 28 of the hollow interior of the knob body 20.

In the illustrated embodiment, four such teeth 42 are provided, although fewer or more such teeth may be utilized without departing from the invention. Also, in the embodiment herein illustrated, the pinion teeth are thirty-six in number, thus providing substantially equal, incremental ten-degree angular arcs of movement of the knob as the teeth 42 thereof engage adjacent respective ones of the teeth 40. This gives a ten degree resolution between possible positions or settings of the knob 10 of the illustrated embodiment. However it will be understood that fewer or more such teeth 40 may be provided for either increasing or decreasing the angular resolution of the knob without departing from the invention.

Further in accordance with the invention, resilient biasing means which, in the illustrated embodiment, take the form of a compression spring 50, are provided for normally holding the locking means or teeth 40, 42 in an engaged or interengaged condition. When in this condition, the pinion 40 prevents rotation of the knob body and cap and hence of the shaft 16. However, the compression spring is resiliently deformable, and in the illustrated embodiment may be further compressed by generally downward axial pressure on the knob body and cap to move the respective teeth 40, 42 into a disengaged condition for permitting rotation of the shaft by the body and cap. The respective engaged and disengaged positions or conditions are shown respectively in FIGS. 3 and 4. In the illustrated embodiment, the compression spring 50 is engaged between the cap 3 and the pinion 34, for normally holding the teeth 42 of the body in engagement with the teeth 40 of the pinion as shown in FIG. 3.

In this regard, the pinion includes a downwardly extending, generally cylindrical skirt portion 52 which has an outer diameter smaller than the inner or minor diameter defined by the teeth 40. This skirt portion 52 has an axial height sufficiently great and a diameter sufficiently small to receive the teeth 42 of the base freely rotatable thereabout when the base and cap are depressed, as indicated by arrow 55 in FIG. 4, so as to overcome or resiliently deform or compress the spring 50 so as to disengage the respective teeth. The pinion skirt also defines in part an interior recess 56 for receiving a fastener 58 which engages a shoulder 59 of the pinion. In the illustrated embodiment fastener 58 comprises an internally threaded, nut-like member for threaded engagement about a complementary externally threaded sleeve portion 60, which is attached to and projects from the potentiometer 12 in surrounding relation to shaft 16. Hence, this fastener or nut 58 holds the pinion in place with respect to the shaft 16, and also with respect to surface or panel 14, and in particular holds the positioning pin or post 36 in the aperture provided therefor in panel 14, so as to hold the pinion in the desired stationary, non-rotatable position relative to the shaft 16. This arrangement also fixes the height of the teeth 40 relative to surface 14 and assures the desired engagement and disengagement thereof with the teeth 42 of the knob body upon bidirectional movement thereof in response to the force of spring 50 on the one hand and force 55 to overcome the spring 50 on the other hand as described above.

Figure 3:
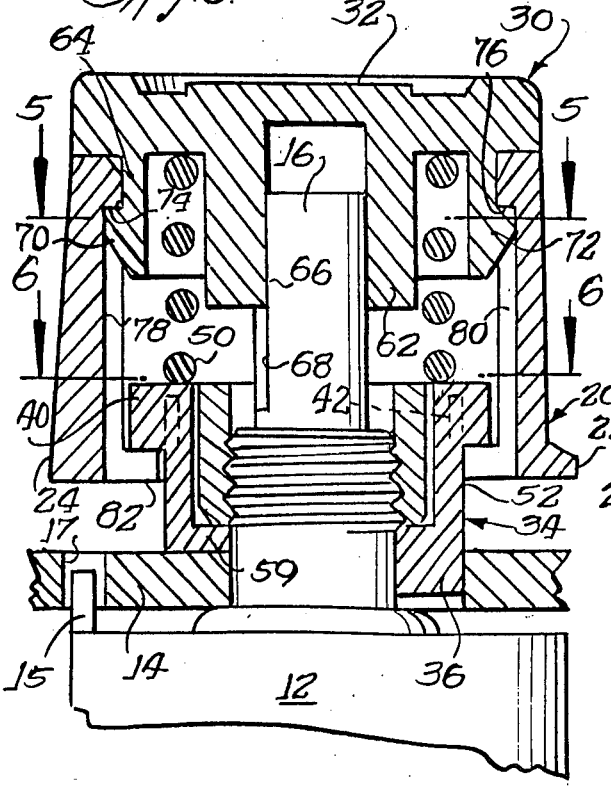
FIG. 3 is a sectional view taken generally in the plane of line 3—3 of FIG. 2 and showing the knob of the invention in a locked, non-rotatable condition.
Figure 4:
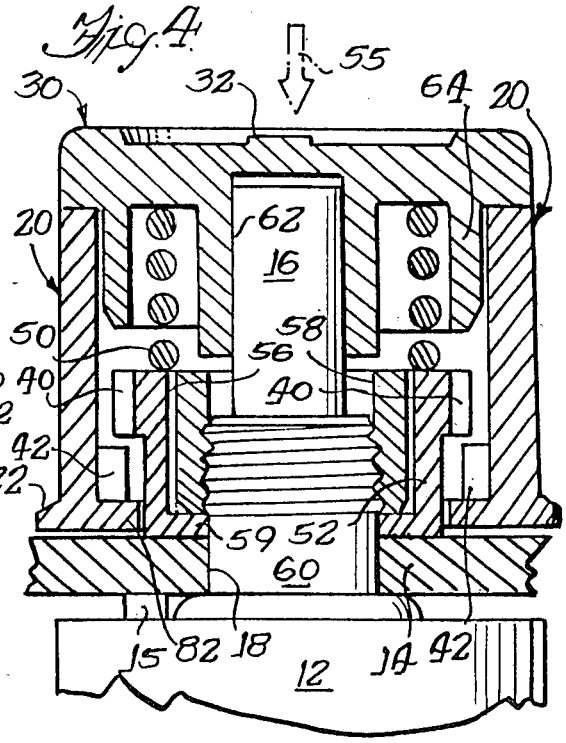
FIG. 4 is a sectional view taken generally in the plane of line 4—4 of FIG. 2 and showing the knob of the invention in an unlocked, rotatable condition.

Referring now more particularly to the cap 30, as best viewed in FIG. 3 and 4, the cap 30 has respective radially inner and radially outer depending skirt members or portions 62, 64. The radially inner skirt 64 is generally cylindrical in form and has one flat or flatted surface portion 66 for engagement with the like cylindrical form of shaft 16 with its complementary flatted surface 68. This holds the cap in non-rotatable engagement with the shaft 16 for rotating the same as the cap is rotated.

Figure 5:
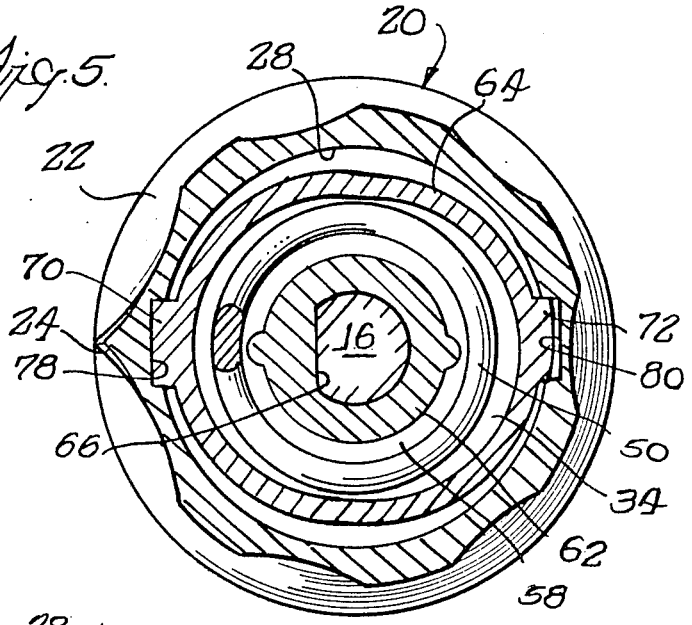
FIG. 5 is a sectional view taken generally in the plane of the line 5—5 of FIG. 3.
Figure 6:
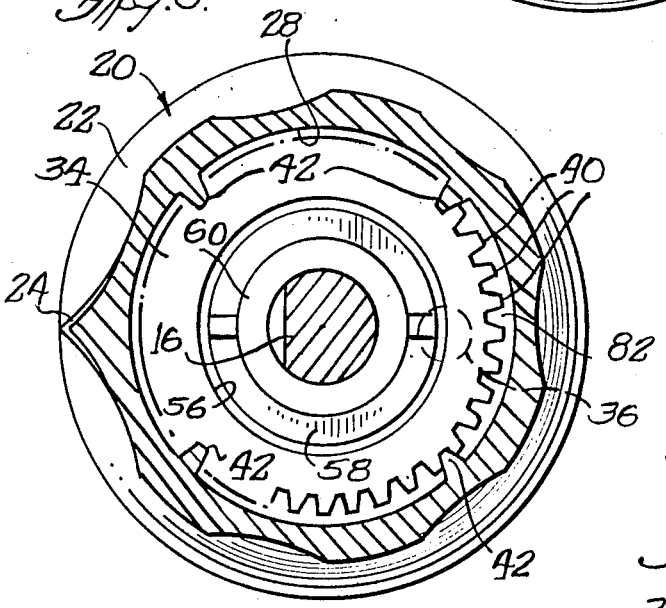
FIG. 6 is a sectional view taken generally in the plane of the line 6—6 of FIG. 3.
Figure 7:
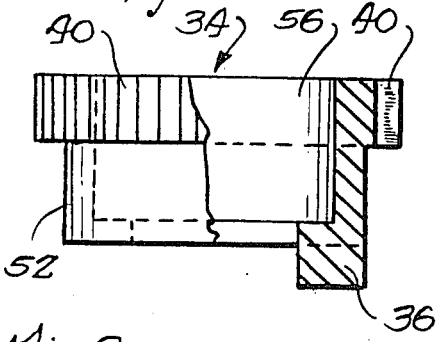
FIG. 7 is an elevational view, partially broken away and partially in section, of a pinion member of the knob assembly of the invention.
Figure 8:
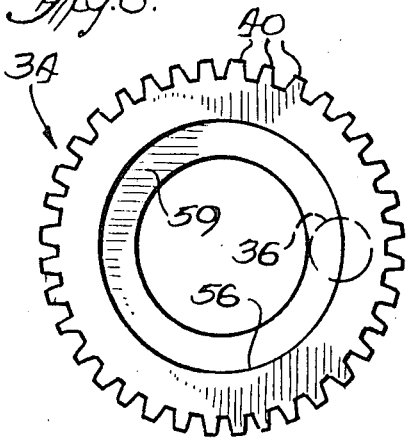
FIG. 8 is a top plan view of the pinion member of FIG. 7.

The outer cylindrical skirt 64 is of a generally oval or elliptical form as best seen in FIG. 5. The maximum diameter or cross-sectional width of skirt 64 is greater than the inner diameter across inner wall 28 of knob body 20 so as to be engaged therewithin in a press fit or friction fit. In this regard, the skirt 64 is resiliently deformable to permit this press fit type of engagement. Additionally, the skirt 64 includes a pair of resilient, radially outwardly extending tabs or tab means 70, 72, formed in the skirt 64. Cooperatively, the interior wall 28 of body 20 is formed with a pair of undercut shoulders 74, 76 and generally axially downardly extending groove portions 78, 80 extending beneath and generally defining the undercut shoulders 74 and 76. These shoulder-and-groove arrangements are positioned and configured to receive the tabs 70, 72 in a resilient snap-in locking type of engagement. As best viewed in FIG. 3, this engagement holds the cap positively engaged with the body 20 and substantially nonmovable relative thereto in both axial and radial directions, as well as non-rotatably engaged. This positive engagement is achieved by the engagement of the respective tabs 70, 72 with the grooves 78, 80 and undercut shoulders 74, 76 defined thereby.

Additionally the leading edges of the skirt 64 including the tabs 70, 72 formed in the skirt are preferably inwardly tapered to facilitate the initial positioning and engagement thereof with the body 20 and for aiding in achieving the described interlocking of the tabs 70, 72 therewith. Preferably, the upper surface of the body 20 also has complementary receiving tapers directly above respective shoulders 74, 76 for receiving and guiding the tabs and skirt 64 into engagement therewith. In this regard, it should be appreciated that the resilient, elastically deformable nature of the oval or elliptical skirt 64 cooperates in achieving the snap-in type of engagement described as between the locking tabs and shoulders of the cap and body, respectively.

It will be seen that the compression spring 50 abuts, at its respective axial ends, the uppermost surface of the pinion 40 on the one side and an undersurface of the cap 30 between the inner and outer depending skirts 62, 64 on the other side. The locations and radial spacing between the depending skirts will be seen to facilitate the maintenance of the spring 50 in its desired orientation.

In the embodiment illustrated, the potentiometer body 12 also includes a locating and locking projecting tab 15 which projects into a suitable aperture 17 provided therefor in the panel 14 so as to reliably hold the same in a non-rotatable condition relative to the panel. This assures that rotation of the shaft 16 by the knob assembly of the invention will indeed achieve the desired rotation of the internal elements of the potentiometer, with the body thereof being thus held in a stationary or non-rotatable condition. Moreover, it will be seen that the fastener member or nut 58 of the invention additionally serves to hold the potentiometer 12 in place relative to the panel 14, due to its engagement with the threaded skirt 60 thereof.

Accordingly, the knob assembly of the invention as described hereinabove provides a relatively simple and inexpensive five-piece assembly which may be quickly assembled to a potentiometer or other device extending through a wall or panel, with the knob body and cap being held captive by the pinion when assembled. This latter captive assembled relationship is accomplished by an inwardly radially projecting lip or rim 82 formed at a lower axial end of the knob body 20. That is, rim or lip 82 extends inwardly of the wall 28 to define an inner diameter smaller than the outer diameter of the pinion teeth 40, to thereby permit engagement thereof with teeth 42, while preventing further relative axial upward movement of the knob body with respect to the pinion.

In practice, it s contemplated that the knob assembly of the invention will be assembled with a potentiometer such as potentiometer 12, or some other similar device by initially inserting the potentiometer or other device with its control shaft extending through a suitable mounting aperture in a panel, such as panel 14. Thereupon, a portion of the knob is initially preassembled by inserting the pinion through the open top and into the inside of the knob body, and thereupon inserting the pinion and body about the skirt 60 of the potentiometer 12. Thereupon, the threaded fastener or nut member is inserted into the open interior 56 of the pinion and threadably engaged with the threaded end of skirt 60. Thereafter the compression spring 50 is inserted within the body so as to rest upon the upper surface of pinion 40, whereupon the cap is aligned respectively with the shaft 16 and with the knob body 20 and snappingly engaged by applying a downward force thereto.

Disassembly of the knob in accordance with the invention is also permitted in a relatively simple and straightforward manner. Namely, a compressive or squeezing force is applied to the knob body in a direction generally perpendicular to the pointer 24. It should be noted that pointer 24 and corresponding pointer 32 lie generally perpendicular to or transverse to the locking tabs 70, 72 and maximum diameter of the oval skirt 64. Accordingly, this pressure on the resilient knob body will cause the body to elongate along its corresponding diameter to thereby generally spread apart respective shoulders 74, 76 releasing their engagement with the locking tabs 70 and 72 to permit removal of the cap. This permits access to the interior of the body and the nut or fastener 58 to accomplish disassembly in generally the reverse order of assembly given above.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim of the appended claims is to cover all such changes and modifications as fall within the true spirit and scope of the invention.

The invention is claimed as follows:

1. A positive-positioning knob assembly comprising: a knob body having a hollow, open-ended substantially cylindrical interior; a pinion member fixed against rotation; cap means non-rotatably mountable to said body and to said shaft for providing a top closure for the former and for rotating said shaft in response to rotation of said body and cap relative to said pinion member; cooperating, selectively interengageable and disengageable locking means on said pinion member and said body respectively for alternatively permitting said body and shaft to rotate freely of said pinion member when said locking means are in a disengaged condition, and for locking said body and shaft non-rotatably relative to said pinion when said locking means are in an engaged condition; and resilient biasing means for normally holding said locking means in said engaged condition to prevent rotation of said shaft by said knob body and cap, and resiliently deformable for permitting said locking means to move to said disengaged condition for permitting rotation of said shaft by said body and cap; wherein said locking means comprises a plurality of contiguous circumferentially arrayed radially outwardly projecting teeth on said pinion member and at least one complementary, radially inwardly projecting tooth on said hollow interior of said body, and wherein said resilient biasing means comprises a compression spring engaged between said pinion member and said cap for normally holding the teeth of said body in engagement with the teeth of said pinion, wherein said body extends to surround and protect said teeth of said pinion at all times, and wherein said spring is resiliently compressible for permitting the teeth of said body to disengage the teeth of said pinion to permit rotation of said body and cap relative to said pinion and hence permit rotation of said shaft thereby.

2. An assembly according to claim 1, wherein said cap has a radially inner depending skirt for non-rotatable engagement with said shaft and a resiliently deformable, generally oval radially outer depending skirt portion having a maximum transverse dimension greater than an inner diameter of said body hollow interior for interfitting therewith in a friction fit.

3. An assembly according to claim 2, wherein said inner depending skirt of said cap defines a generally cylindrical hollow interior having a flat surface portion for complementary engagement with a shaft of like cross-sectional form to be turned by said knob.

4. An assembly according to claim 2 and further including resilient, radially outwardly extending tab means formed at a lower portion of said outer skirt of said cap and respective undercut shoulder-and-groove portions formed in said hollow body and dimensioned and positioned for engagement with said tabs for holding the cap non-rotatable as well as axially engaged with respect to the body.

5. An assembly according to claim 1 and further including a fastener member for holding said pinion engaged about said shaft and locating pin means on said pinion for engagement with a locating surface defined adjacent said shaft for holding said pinion fixed against rotation and for locating said pinion relative to said shaft.

6. An assembly according to claim 1, wherein said pinion includes a downwardly extending, generally cylindrical skirt portion having an outer diameter smaller than an inner diameter defined by the teeth thereof and of sufficient axial height to receive said body teeth freely rotatable thereabout when said body and said cap are depressed to overcome said compression spring and disengage the respective teeth.

7. An assembly according to claim 6, wherein said pinion skirt defines an interior recess for receiving said fastener, the latter comprising an internally threaded fastener.

8. An assembly according to claim 1, wherein said compression spring abuts an undersurface of said cap and a surface of said pinion facing said under-surface of said cap.

9. An assembly according to claim 1, wherein said pinion teeth are substantially equally angularly spaced so as to define incremental rotation positions of said body relative to said shaft, said teeth being of sufficient number to define a desired angular resolution of said incremental shaft rotation.

10. A positive-positioning knob assembly comprising: a knob body having a hollow, open-ended substantially cylindrical interior; a pinion member fixed against rotation; cap means non-rotatably mountable to said body and to said shaft for providing a top closure for the former and for rotating said shaft in response to rotation of said body and cap relative to said pinion member; cooperating, selectively interengageable and disengageable locking means on said pinion member and said body respectively for alternatively permitting said body and shaft to rotate freely of said pinion member when said locking means are in a disengaged condition, and for locking said body and shaft non-rotatably relative to said pinion when said locking means are in an engaged condition; and resilient biasing means for normally holding said locking means in said engaged condition to prevent rotation of said shaft by said knob body and cap, and resiliently deformable for permitting said locking means to move to said disengaged condition for permitting rotation of said shaft by said body and cap; wherein said locking means comprises a plurality of circumferentially spaced, radially outwardly projecting teeth on said pinion member and at least one complementary, radially inwardly projecting tooth on said hollow interior of said body, and wherein said resilient biasing means comprises a compression spring engaged between said pinion member and said cap for normally holding the teeth of said body in engagement with the teeth of said pinion, and resiliently compressible for permitting the teeth of said body to disengage the teeth of said pinion to permit rotation of said body and cap relative to said pinion and hence permit rotation of said shaft thereby; and wherein said pinion includes a downwardly extending, generally cylindrical skirt portion having an outer diameter smaller than an inner diameter defined by the teeth thereof and of sufficient axial height to receive said body teeth freely rotatable thereabout when said body and said cap are depressed to overcome said compression spring and disengage the respective teeth.

11. A positive-positioning knob assembly comprising: a knob body having a hollow, open-ended substantially cylindrical interior; a pinion member fixed against rotation; cap means non-rotatably mountable to said body and to said shaft for providing a top closure for the former and for rotating said shaft in response to rotation of said body and cap relative to said pinion member; cooperating, selectively interengageable and disengageable locking means on said pinion member and said body respectively for alternatively permitting said body and shaft to rotate freely of said pinion member when said locking means are in a disengaged condition, and for locking said body and shaft non-rotatably relative to said pinion when said locking means are in an engaged condition; and resilient biasing means for normally holding said locking means in said engaged condition to prevent rotation of said shaft by said knob body and cap, and resiliently deformable for permitting said locking means to move to said disengaged condition for permitting rotation of said shaft by said body and cap; wherein said cap has a radially inner depending skirt for non-rotatable engagement with said shaft and a resiliently deformable, generally oval radially outer depending skirt portion having a maximum transverse dimension greater than an inner diameter of said body hollow interior for interfitting therewith in a friction fit.

12. A positive-positioning knob assembly comprising: a knob body having a hollow, open-ended substantially cylindrical interior; a pinion member fixed against rotation; cap means non-rotatably mountable to said body and to said shaft for providing a top closure for the former and for rotating said shaft in response to rotation of said body and cap relative to said pinion member; cooperating, selectively interengageable and disengageable locking means on said pinion member and said body respectively for alternatively permitting said body and shaft to rotate freely of said pinion member when said locking means are in a disengaged condition, and for locking said body and shaft non-rotatably relative to said pinion when said locking means are in an engaged condition; and resilient biasing means for normally holding said locking means in said engaged condition to prevent rotation of said shaft by said knob body and cap, and resiliently deformable for permitting said locking means to move to said disengaged condition for permitting rotation of said shaft by said body and cap; wherein said locking means comprises a plurality of circumferentially spaced, radially outwardly projecting teeth on said pinion member and at least one complementary, radially inwardly projecting tooth on said hollow interior of said body, and wherein said resilient biasing means comprises a compression spring engaged between said pinion member and said cap for normally holding the teeth of said body in engagement with the teeth of said pinion and resiliently compressible for permitting the teeth of said body to disengage the teeth of said pinion to permit rotation of said body and cap relative to said pinion and hence permit rotation of said shaft thereby; and wherein said compression spring abuts an undersurface of said cap and a surface of said pinion facing said under-surface of said cap.

13. A positive-positioning knob assembly comprising: a knob body having a substantially hollow interior portion; a pinion member fixed against rotation; cooperating, selectively interengageable and disengageable locking means on said pinion member and said hollow body interior respectively for alternatively permitting said body to rotate freely of said pinion member when said locking means are in a disengaged condition, and for locking said body non-rotatably relative to said pinion when said locking means are in an engaged condition; and resilient biasing means for normally holding said locking means in said engaged condition to prevent rotation of said knob body; said resilient biasing means being resiliently deformable for permitting said locking means to move to said disengaged condition for permitting rotation of said knob body; and further including a cap which has a radially inner depending skirt for non-rotatable engagement with said shaft and a resiliently deformable, generally oval radially outer depending skirt portion having a maximum transverse dimension greater than an inner diameter of said base hollow interior for interfitting therewith in a friction fit.

* * * * *